US006948829B2

(12) United States Patent
Verdes et al.

(10) Patent No.: US 6,948,829 B2
(45) Date of Patent: Sep. 27, 2005

(54) LIGHT EMITTING DIODE (LED) LIGHT BULBS

(75) Inventors: Anthony Verdes, Brick, NJ (US); Yuming Chen, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 23 days.

(21) Appl. No.: 10/765,141

(22) Filed: Jan. 28, 2004

(65) Prior Publication Data

US 2005/0162864 A1 Jul. 28, 2005

(51) Int. Cl.[7] ..... F25D 27/00; F27D 21/02

(52) U.S. Cl. ..... 362/227; 362/294; 362/545; 362/236; 362/800; 362/230; 362/252; 362/126; 315/71

(58) Field of Search ..... 362/545, 236, 362/252, 800, 294, 227, 126, 230; 315/71

(56) References Cited

U.S. PATENT DOCUMENTS

| | | | | |
|---|---|---|---|---|
| 4,727,289 | A * | 2/1988 | Uchida | 315/71 |
| 6,227,679 | B1 * | 5/2001 | Zhang et al. | 362/236 |
| 6,499,860 | B2 * | 12/2002 | Begemann | 362/230 |
| 6,659,632 | B2 * | 12/2003 | Chen | 362/545 |

* cited by examiner

*Primary Examiner*—Thomas M. Sember
*Assistant Examiner*—James W Cranson, Jr.
(74) *Attorney, Agent, or Firm*—Oblon, Spivak, McClelland, Maier & Neustadt, P.C.

(57) ABSTRACT

A light emitting diode (LED) light bulb that includes plural individual elements as sub-assembly elements of the overall light bulb. Different sub-assembly elements of a lens, a LED printed circuit board, a housing also functioning as a heat sink, a lower housing, and other individual sub-assembly components are utilized. The LED printed circuit board sub-assembly containing the LEDs can also be provided relatively close to a base.

22 Claims, 2 Drawing Sheets

LIGHT EMITTING DIODE (LED) LIGHT BULBS

BACKGROUND OF THE INVENTION

1. Field of the Invention

The present invention is directed to light bulbs that utilize light emitting diodes (LEDs) as the light emission elements.

2. Discussion of the Background

Light bulbs in use typically utilize an incandescent light source. However, recently interest has been developed in utilizing LEDs as a light source in a light bulb, for example in an indicator or as special lightings. An LED light bulb can find application in indoor and outdoor applications, and one particular application of utilizing an LED light bulb is to replace colored incandescent light bulbs, since LEDs commonly output light of a particular color, for example red. The conventional approach utilizing LEDs in light bulbs is to place the LEDs to directly face the surface of a lens, such as a bulb or a cover.

SUMMARY OF THE INVENTION

However, the applicants of the present invention have recognized that existing LED light bulbs suffer from several significant drawbacks. As noted above, in existing LED light bulbs the LEDs directly face the surface of the lens, and as a result the LEDs are located away from the base of the bulb. As a result, in such devices it is difficult to utilize a heat sink effectively. Further, as the LEDs are located towards the center of the lens, it is possible that a darker (nonlit) area may develop close to the base. It is also difficult to economically manufacture such light bulbs for various uses, such as employing mixed color LEDs to obtain different color light outputs.

Accordingly, one object of the present invention is to provide a novel LED light bulb that provides enhanced performance.

A more specific object of the present invention is to provide a novel LED light bulb that is simple to manufacture and is simple to vary in manufacture, particularly as LED technology is still changing rapidly.

A more specific object of the present invention is to provide a novel LED light bulb that can provide effective heat sinking, and which avoids developing nonlit areas close to a base.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
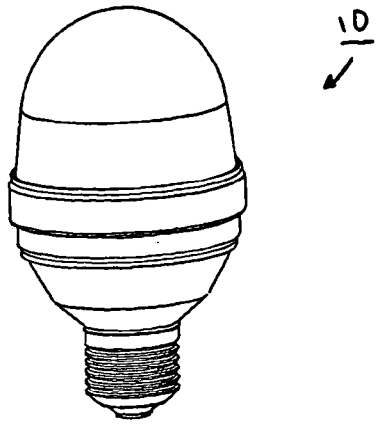
FIG. 1 shows an external view of an LED light bulb of the present invention.

Referring now to the drawings, wherein like reference numerals designate identical or corresponding parts throughout the several views, and more particularly to FIG. 1 thereof, an external view of an LED light bulb 10 of the present invention is shown. The LED light bulb 10 can be designed to be fit into existing light bulb sockets.

Figure 2:
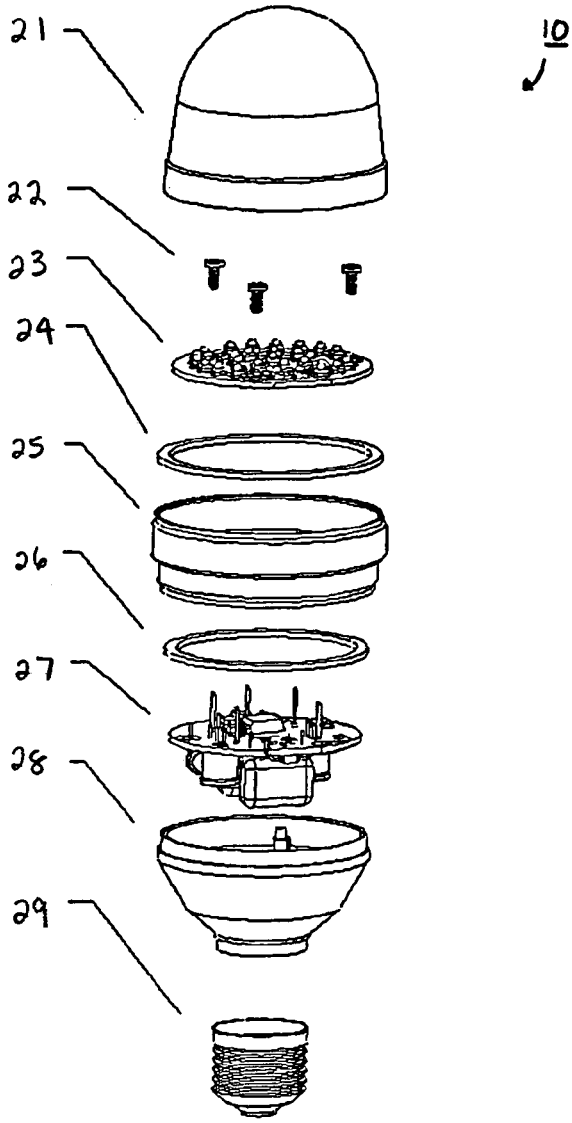
FIG. 2 shows an exploded view of the LED light bulb of FIG. 1.
Figure 3:
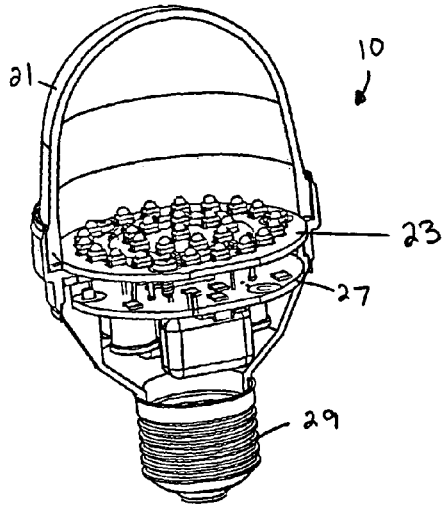
FIG. 3 shows a cutaway view of the LED light bulb of FIGS. 1 and 2.

FIG. 2 shows an exploded view of the LED light bulb 10 of FIG. 1 and FIG. 3 shows a cut away view of the same LED light bulb 10.

As shown in FIG. 2, the LED light bulb 10 includes a lens 21, which may typically be formed of plastic. A center housing 25 also operating as a heat sink is provided. An LED printed circuit board (PCB) sub-assembly 23 including plural LEDs is mounted to the center housing 25 with a gasket lens 24 therebetween by plural screws 22. The gasket lens 24 is not a required element when assembling the LED PCB sub-assembly 23. The gasket lens 24 goes around the outside edge of the LED PCB sub-assembly 23 and is provided to create a seal between the lens 21 and the housing 25. The lens 21 is then fit over the LED PCB sub-assembly 23 and can be adhesively secured to the center housing 25. The lens 21 can be mechanically secured to the housing 25 by, for example, a crimping operation in which the top edge of the housing 25 is curled over a lip of the lens 21. Such a lens assembly can be a last operation in assembling the overall light bulb 10. Such an operation assists in designing options in lens profiles depending on customer requirements. The center housing 25 is then connected to a lower housing 28 through a housing gasket 26. The lower housing 28 is then secured onto the base 29. The base 29 is configured to fit into an electrical socket.

The center housing 25 can preferably be a finished aluminum part designed to dissipate heat away from the LED PCB sub-assembly 23. The housing 25 is designed to work with the lens 21 profile and the lower housing 28 for assembly purposes. Such a layout allows fitting different types of LED technologies without having to change other components.

Further, a power supply printed circuit board (PCB) sub-assembly 27 is also provided to fit into the lower housing 28. The power supply PCB sub-assembly 27 includes electrical connections to connect with the LED PCB sub-assembly 23 to supply power to the LEDs on the LED PCB sub-assembly 23.

The LED light bulb of FIGS. 1–3 with the structure noted above provides several significant beneficial features.

First, the center housing 25 can operate as a heat sink to thereby allow the use of plural currently available LEDs to be mounted on the LED PCB sub-assembly 23.

Further, the LED PCB sub-assembly 23 is essentially only one module of the entire light bulb 10. As a result, the LED PCB sub-assembly 23 can be easily modified to be varied for different desired applications and to suit new LED technology as it becomes available. That is, as the separate LED PCB sub-assembly 23 is a sub-element with the noted structure, it is easy to modify that sub-assembly 23 in terms of, for example, the LEDs mounted thereon, without changing the size, shape, etc. of the LED PCB sub-assembly 23 so that it can still be fit into the same existing LED light bulb 10.

Further, since the LED PCB sub-assembly 23 is a simple modular element, it can be designed to mix different color LEDs for different particular applications as selected by different customers. Such different LED PCB sub-assemblies 23 can then easily and economically be manufactured into the same LED light bulb 10.

Further, by utilizing a lower housing 28 as a modular element, that lower housing 28 can be changed to achieve different height requirements in different light bulbs.

As the lens 21 is also only a sub-assembly component of the overall light bulb 10, the lens 21 can be changed in its shape, material, etc., to suit different requirements.

Moreover, with the overall structure shown most clearly in FIG. 3, the LEDs on the LED printed circuit board sub-assembly 23 are amounted close to the base. As a result, light can be evenly distributed in the lens 21. That provides enhanced light output effects by the LED light bulb 10.

Thus, a feature of the LED light bulb 10 shown in FIGS. 1–3 is that it is composed of several sub-element assemblies that are put together. Utilizing several sub-element assemblies allows maximum flexibility in manufacturing of the LED light bulb 10 and in modifying the LED light bulb 10. That is, by utilizing several sub-assemblies as components of the LED light bulb 10, each individual sub-assembly can be modified for a desired application. Examples of two specific modifications are now discussed below.

Figure 4:
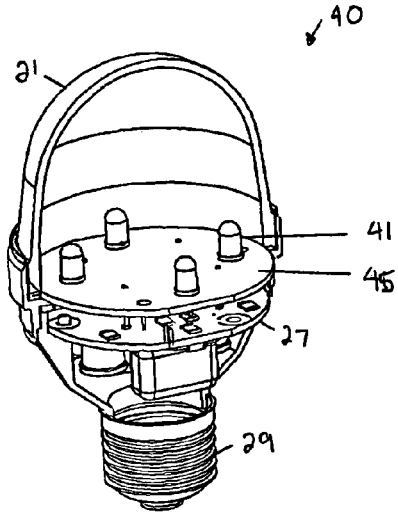
FIG. 4 shows a further embodiment of an LED light bulb of the present invention.
Figure 5:
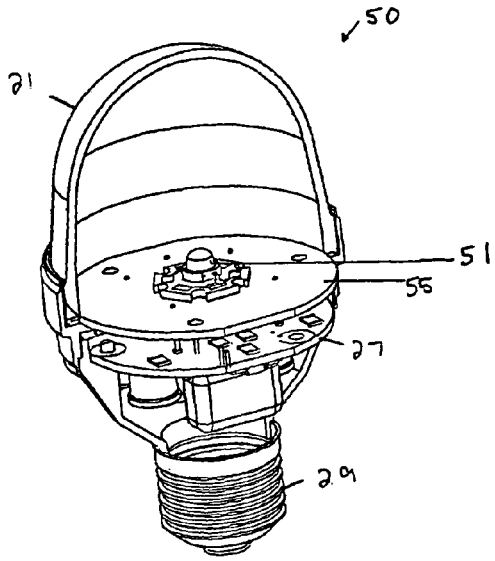
FIG. 5 shows a further embodiment of an LED light bulb of the present invention.

As noted above, one of the benefits of the LED light bulb 10 of FIGS. 1–3 is that the LED printed circuit board sub-assembly 23 can be easily modified. FIGS. 4 and 5 show two separate modifications of the LED light bulb 10 in which only the LED printed circuit board sub-assembly 23 of FIG. 2 is replaced with different printed circuit board LED sub-assemblies.

The LED technology utilized in the various light bulbs can be varied in many ways as desired by a user, for example with respect to light output requirements, color output requirements, cost requirements, etc. as desired by a user, and FIGS. 4 and 5 only show two potential modifications easily achievable by the present invention.

As shown in FIG. 4, the LED light bulb 40 includes a different LED printed circuit board sub-assembly 45 that includes fewer LEDs 41, which can be conventional 5 mm LEDs. Thus, the number of LEDs on a printed circuit board sub-assembly can also be varied, for example if a dim light application is desired.

FIG. 5 shows a further modification in which the LED light bulb 50 includes a different LED printed circuit board sub-assembly 55 including only a single high-flux LED 51 which for example can be Luxeon from LumiLeds.

As evident from FIGS. 4 and 5, the different LED light bulbs 40, 50 therein can be easily manufactured by merely changing an LED printed circuit board sub-assembly as one element of the overall light bulb. Such manufacturing flexibility can significantly enhance the cost structure, design time, manufacturing flexibility, etc. of manufacturing an LED light bulb.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A light bulb comprising:

(a) a board supporting at least one light emitting diode (LED);

(b) a base housing;

(c) a heat sink housing configured to be secured to said base housing at a first end of said heat sink housing and configured to receive said board at a second end of said heat sink housing, opposite to said first end of said heat sink housing, said heat sink housing further configured to have sufficient thermal mass to act as a heat sink; and (d) a power supply sub-assembly configured to fit into said base housing and to provide power to said at least one LED on said board.

2. A light bulb according to claim 1, further comprising:

(e) a lens to fit over said board and to connect to said heat sink housing at said second end of said heat sink housing.

3. A light bulb according to claim 1, wherein said at least one LED includes plural LEDs mounted on said board.

4. A light bulb according to claim 1, wherein said at least one LED includes plural LEDs mounted on said board.

5. A light bulb according to claim 1, wherein said lens is made of plastic.

6. A light bulb according to claim 2, wherein said lens is made of plastic.

7. A light bulb comprising:

(a) means for supporting at least one light emitting diode (LED);

(b) first means for housing said means for supporting; and (c) second means for housing to be secured to said first means for housing at a first end of said second means for housing and for receiving said means for supporting at a second end of said second means for housing, opposite to said first end of said second means for housing, said second means for housing further configured to have sufficient thermal mass to act as a heat sink.

8. A light bulb according to claim 7, further comprising:

(d) means to fit into said first means for housing and for providing power to said at least one LED on said means for supporting.

9. A light bulb according to claim 7, further comprising:

(d) light output means for fitting over said means for supporting and to connect to said second means for housing at said second end of said second means for housing.

10. A light bulb according to claim 8, further comprising:

(e) light output means for fitting over said means for supporting and to connect to said second means for housing at said second end of said second means for housing.

11. A light bulb according to claim 7, wherein said at least one LED includes plural LEDs mounted on said means for supporting.

12. A light bulb according to claim 8, wherein said at least one LED includes plural LEDs mounted on said means for supporting.

13. A light bulb according to claim 9, wherein said light output means is made of plastic.

14. A light bulb according to claim 10, wherein said light output means is made of plastic.

15. A light bulb comprising:

(a) a board supporting at least one light emitting diode (LED);

(b) a base housing; and (c) a heat sink housing forming an outer portion of the light bulb and configured to be secured to said base housing at a first end of said heat sink housing and configured to receive said board at a second end of said heat sink housing, opposite to said first end of said heat sink housing, said heat sink housing further configured to have sufficient thermal mass to act as a heat sink.

16. A light bulb according to claim 15, further comprising:

(d) a power supply sub-assembly configured to fit into said base housing and to provide power to said at least one LED on said board.

17. A light bulb according to claim 15, further comprising:

(d) a lens to fit over said board and to connect to said heat sink housing at said second end of said heat sink housing.

18. A light bulb according to claim 16, further comprising:

(e) a lens to fit over said board and to connect to said heat sink housing at said second end of said heat sink housing.

19. A light bulb according to claim 15, wherein said at least one LED includes plural LEDs mounted on said board.

20. A light bulb according to claim 16, wherein said at least one LED includes plural LEDs mounted on said board.

21. A light bulb according to claim 17, wherein said lens is made of plastic.

22. A light bulb according to claim 18, wherein said lens is made of plastic.

* * * * *